United States Patent [19]

Courchesne et al.

[11] Patent Number: 4,957,185

[45] Date of Patent: Sep. 18, 1990

[54] ROOF SCAFFOLD

[76] Inventors: Claude J. F. Courchesne, 19 Bluebell Crescent, Ancaster, Ontario, Canada, L9K 1G2; Theodore R. Palmer, 309 Orkney Street West c/o General Delivery, Caledonia, Ontario, Canada, N0A 1A0

[21] Appl. No.: 479,051

[22] Filed: Feb. 12, 1990

[51] Int. Cl.[5] ..... E04G 3/12

[52] U.S. Cl. ..... 182/150; 182/45; 182/82; 248/237

[58] Field of Search ..... 182/150, 45, 82, 113; 248/237

[56] References Cited

U.S. PATENT DOCUMENTS

| | | | |
|---|---|---|---|
| 1,442,697 | 1/1923 | Orthmann | 182/150 |
| 1,558,425 | 10/1925 | Yetter | 182/150 |
| 1,926,207 | 9/1933 | MacAlpine | 182/150 |
| 2,308,142 | 1/1943 | Alloway | 182/150 |
| 3,158,223 | 11/1964 | Brown | 182/150 |
| 3,292,734 | 12/1966 | Swanberg | 182/45 |
| 3,526,296 | 9/1970 | Stevens | 182/45 |
| 3,552,522 | 1/1971 | Bobo | 182/150 |
| 4,074,792 | 2/1978 | Ziaugg | 182/150 |

FOREIGN PATENT DOCUMENTS

| | | | |
|---|---|---|---|
| 800788 | 12/1950 | Fed. Rep. of Germany | 182/150 |
| 845104 | 7/1952 | Fed. Rep. of Germany | 182/150 |

*Primary Examiner*—Reinaldo P. Machado
*Attorney, Agent, or Firm*—McConnell and Fox

[57] ABSTRACT

A scaffold bracket for suspensing scaffolding from a pitched roof in such a manner as to permit roofing up to the edge of the roof without interference, the scaffolding bracket being of such a structure as to permit easy adjustment and installation and subsequent removal, the point of support for the scaffold bracket lying outside the surface of the roof during use.

10 Claims, 2 Drawing Sheets

ROOF SCAFFOLD

FIELD OF THE INVENTION

This invention relates to scaffold supports and in particular supports which suspend the scaffold from the roof of a building.

DESCRIPTION OF THE PRIOR ART

When working on roofs in the process of repairing shingling or applying other roofing, it is necessary that the workman be supported in a safe and convenient manner. It has been common in the past to use various forms of scaffold supported on brackets, mounted on ladders, or mounted on the ground. If the scaffold is directly supported from the ground it is evident that substantial construction may be required to raise the scaffold high enough to provide access to the roof. Much time and effort may be expended in building the scaffold to the proper height which adds to the cost and time consumed in the construction or repair of buildings.

It has been proposed in the past to avoid this to some degree by supporting the scaffold from the roof. Typical of a roof supported scaffold is the scaffold shown in U.S. Pat. No. 1,558,425. This scaffold is supported by means of brackets spiked to the roof with the scaffold support pinned onto the brackets to adapt to various roof pitches. While providing a firm and convenient support for the workman while working on the roof, it is evident that the scaffold does not permit access to the whole of the edge of the roof since the mounting brackets and the attachment of the support structure interferes with the surface of the roof near the edge.

An alternative arrangement is shown in U.S. Pat. No. 3,158,223 issued Nov. 24, 1964 which shows a scaffold supported from the roof in which the supports are not attached to the roof but merely maintain their position by their frictional engagement with the roof.

A somewhat similar arrangement is shown in U.S. Pat. No. 4,074,792 which once again is suspended from the roof by members which do not actually fasten to the roof but are merely held in position by their frictional engagement or extended prongs.

These latter patents show inventions which permit access to the edge of the roof but obstruct continued operation and hence are not useful in shingling since the frictional engaging pads interfere with the process of shingling. Also, since there is no positive connection of the pads and the roof, the support is uncertain particularly in the case of steep pitch roofs.

It is desirable to design a roof supported scaffold support which is light and easily portable which permits access and work over the whole of the roof surface without interfering with the shingling process and that provides adequate safety for the workman.

SUMMARY OF THE INVENTION

In accordance with the present invention, a scaffold support bracket is supported from a cleat which is positively but removably secured to the roof in such a manner that shingling or other roofing may be applied over the cleat and yet the cleat may be subsequently removed without damaging the roof surface. The bracket is supported from a point outside the edge of the roof so that the support point does not interfere with the roofing process and the structure of the bracket is such as to provide mounting for additional scaffold planks which provide safety during the continuing roofing process. In addition, the scaffold brackets are sufficiently light and disassembable that they easily may be handled by one man and installed individually, thus minimizing the time required for set-up prior to commencement of roof installation.

A clearer understanding of the invention may be had from a consideration following description and drawings.

DESCRIPTION OF THE PREFERRED EMBODIMENT

Figure 1:
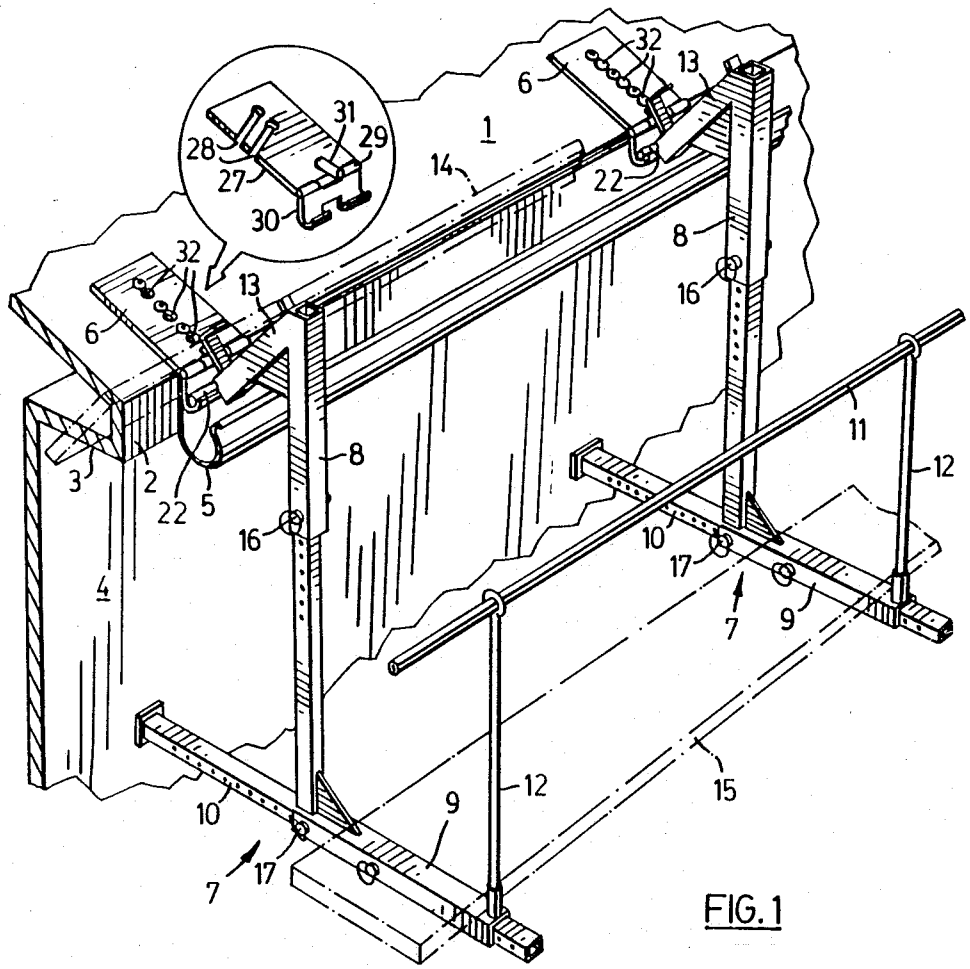
FIG. 1 is an isometric view of scaffold brackets in their installed position on a building including an enlarged view of a roof cleat.

In FIG. 1 there is shown a building having a roof 1 ending in a fascia board 2 and a soffit 3 which joins the bottom edge of the fascia 2 to the wall 4 of the building. Mounted on the fascia board 2 is an eaves trough 5. A number of cleats 6, all identical, are fastened to the roof 1 by means of roofing nails. Details of the cleat 6 are shown enlarged. The cleat 6 ends in a hook, as described in more detail subsequently. The scaffold bracket 7, shown in more detail in FIG. 2, consists of an upright member 8 joined at right angles to horizontal member 9. An adjustable extension leg 10 fits within the horizontal member 9 and is adjustable in a manner shown in more detail in FIG. 2. The leg 10 bears against the wall 4 maintaining the upright member 8 perpendicular. A safety rail 11 is provided and supported by safety rail uprights 12 mounted at the outer ends of the horizontal member 9. The scaffold bracket is connected to the hook on the roof cleat 6 by the scaffold bracket angle member 13 which ends in a pin 22 which engages the hook on the cleat 6. In use, a plank 15 is laid across the horizontal members 9 of two or more scaffold brackets and the workman may then stand on the plank and proceed with the normal roofing operation. The shingles, or whatever other material being laid on the roof, may pass completely over the roof cleat 6 which in no way interfere with the roofing process.

After the roofing has proceeded to such a stage that the workman can no longer work conveniently while standing on plank 15, a further plank 14 may be placed between adjacent angle members 13 to provide a foot hold and safety member for the workman while working above the edge of the roof.

Figure 2:
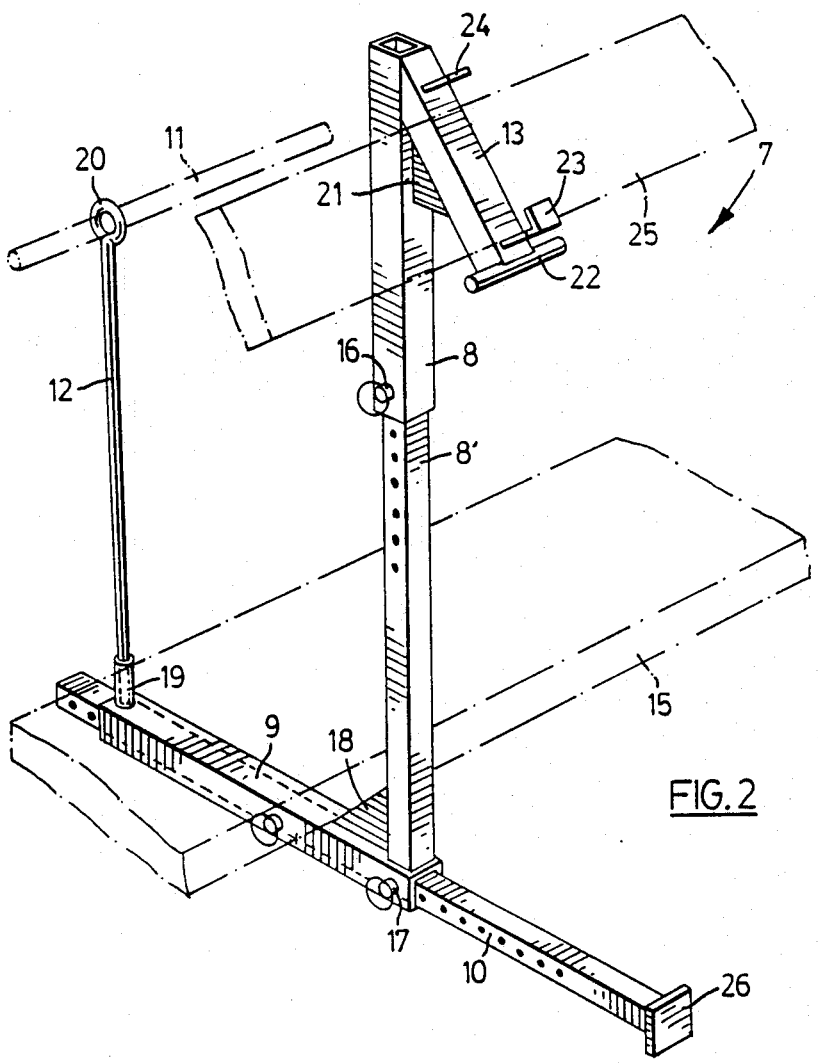
FIG. 2 is an isometric view of a scaffold bracket in greater detail.

Turning now to FIG. 2, it will be seen that the vertical member 8 consists of an upper portion designated 8 and a lower portion designated 8' which fits within the upper portion and is adjustably located relative to portion 8 by means of a locking pin 16 which passes through both members. A plurality of holes in member 8' permit the adjustable location. In a similar manner, extension leg 10 is positioned relative to horizontal member 8 by means of one or more pins 17 which pass through holes in the extension leg 10. The end of the extension leg 10 is provided with a pad 26 distributing the force over an area of the wall 4. A gusset plate 18 joins vertical member 8' to horizontal member 9 to provide the necessary support. At the outer end of horizontal member 9 is mounted a nipple 19 into which the safety rail upright 12 can be slipped, the safety rail upright 12 being a rod with an eye at the top, designated 20. The safety rail 11, which may be a piece of standard pipe, passes through the eye 20 of adjacent scaffold bracket safety rail uprights. The angle support member 13 terminated in a pin 22 which, as has been previously indicated, engages the hook on the end of the cleat 6. A gusset plate 21 fastens the angle member 13 to the upright member 8 to provide the necessary strength. A cleat 23 is welded to the angle member 13, the cleat being of a suitable form to support a plank and a stop 24 is also welded to the angle member spaced from the cleat a sufficient distance to permit a plank to be inserted and held in place. The spacing of the cleat 23 and the stop 24 will depend upon the dimension of the plank intended to be inserted at this point.

As will be seen in the enlarged view in FIG. 1, the roof cleat 6 consists of a fastening plate 27 having nail slots 28 connected by means of a hinge 29 to the hooked end plate 30. An anvil pin 31 is welded onto the fastening plate 27 and onto the portion of the hinge 29 which is fixed to the fastening plate. In the unenlarged view, the fastening plate, rather than having nail slots, is provided with nail holes of a keyhole shape. The upper portion of the holes are sufficient to permit the passage of the shaft of the nail but not the head of the nail. The lower portions are sufficiently large to permit the head of the nail to pass through.

OPERATION

In operation, the workman nails a series of roof cleats 6 to the edge of the roof 1 in such a location that the hinge 29 falls right at the edge of the roof and the hooked end 30 of the cleat hangs straight down against the fascia board 2. With the vertical upright 8 at its desired length, the workman then hooks the pin 5 into the hook at the end of the end plate 30 and adjusts the leg 10 so that the upright 8 is vertical. With a number of scaffold brackets installed in this manner, planks 15 may be laid between members 9 of the adjacent brackets. Safety rail uprights 12 may be inserted in the nipples 19 and suitable safety rail 11 threaded through the eyes 20 at the tops of the uprights. The scaffold is now in position and may be used by the roofer.

In the case of a shingled roof, the first strip of material may now be laid along the edge continuously, proceeding along the scaffold from one end of the roof to the other without interference from the scaffold itself. Roofing may then proceed, covering the roof cleats. After the roof has proceeded to such a stage that it is no longer conveniently accessible from the plank 15, it is possible to adjust the uprights 8 to raise the plank 15 to permit the roofer to reach further up the roof. After a sufficient surface has been laid, the roofer may then proceed onto the roof and work further up.

While working further up on the roof, plank 14 is laid across the angle members 13 held in position by cleat 23 and stop 24 thus providing a safety ledge in case the roofer, while working, slips and slides down towards the edge of the roof.

After the roof is complete, planks 14 can be removed, planks 15 and the safety rail 11 removed. The individual scaffold brackets 7 may now be lifted out of the roof cleats 6 and lowered to the ground. The roof cleats 6 may now be removed by striking the anvil pin 31 which drives the fastening plate 27 up the roof as the hooked plate 30 pivots permitting the fastening plate 27 to move and be driven up as far as it will go. The fastening plate releases from the nails and nail heads either pass through the openings in the bottom of the nail holes or out through the open end of the slots 28 depending on the formation of the roof cleats being used. The anvil pin 31 ensures that the blow struck by the workman in removing the fastening plate is transmitted to the fastening plate and he does not instead strike the hinge and damage the roof cleat. After removal of the roof cleat is complete, no further work is necessary since the cleat has in no way interfered with the installation of the roof.

While no dimensions have been provided, it will be evident to those skilled in the art that the dimensions desirable are those which provide the necessary clearance. For example, the angle and length of the angle member 13 must be such as to provide clearance of normal eaves trough and the end of the pin 22, therefore, should be about 14 centimeters from the upright member 8. The angle of the angle member 13 should be such that the plank 14 is substantially perpendicular to the average pitch of roof. The dimensions of the vertical and horizontal members 8 and 9 should be sufficient to bear the necessary weight of the workman and his materials but should not be so heavy as to make the scaffold support 7 awkward to handle by a single workman. Square steel tubing of about 4 centimeters has been found to be satisfactory for all the members both the vertical and angle members. Naturally, the telescoping members such as extension leg 10 and the vertical member 8' will have to be of somewhat lesser dimension. Pin 22 may be about 2 centimeters in diameter and about 12 centimeters long. The hook at the end of hook plate 30 will be suitably dimensioned to receive pin 22 and preferably the upper outer end of the hook is bent slightly inwardly to permit the pin 22 to snap into place, but not so much as to cause difficulty in installing and removing the pin from the hook.

While specific construction of the various components has been shown, it is evident that many variations may be made within the scope of the invention. It is important, however, in the design and installation of the roof cleat that the hinge 29 is located at the edge of the roof and the hook plate 30 hangs vertically down lying against the fascia board 2. This arrangement ensures that the weight supported by the scaffold bracket applied downward at the hook produces a mechanical couple with the force applied to the wall balanced by an equal pull on the roof cleat fastening plate 27. The pull is therefore primarily parallel to the roof and produces minimal forces tending to pry or lift the cleat off the roof. In other words, the nails holding the cleat to the roof are subject primarily to sheer force and minimal axial pull which minimizes the possibility of the cleat loosening from the roof while in use.

We claim:

1. A scaffold support comprising a roof cleat and a bracket supported therefrom; said roof cleat comprising a flat apertured metal fastening plate connected by a hinge to a hooked end plate; said bracket comprising a vertical member having an upper end and a lower end when arranged in its operative position, said upper end joined to a downwardly projecting angle member which terminates in a pin mounted transverse to the longitudinal axis of said angle member, said lower end of said vertical member being joined to a horizontal member in the same plane as said angle member but at 180° thereto, an extension leg slidably mounted with respect to said horizontal member parallel thereto and projecting in the same direction as said angle member, means to adjustably longitudinally locate said leg with respect to said horizontal member; means to fasten said roof cleat to the edge of the roof of a building having a wall and roof supported thereon with said hinge on the edge of said roof and the hooked end plate hanging down vertically, whereby when said pin is hooked in the hooked end plate and said leg is adjusted to its proper length and bearing against the wall of said building, the vertical member of said bracket is maintained in its vertical position.

2. A scaffold support as claimed in claim 1 wherein said horizontal member includes a cylindrical orifice at its end remote from the end connected to the vertical member and a removable rod safety rail support mounted in said orifice.

3. A scaffold support as claimed in claim 1 including a cleat on the outer surface of said angle member shaped to receive and retain a plank.

4. A scaffold support as claimed in claim 3 including a stop on the outer surface of said angle member positioned to retain said plank in said cleat.

5. A scaffold support as claimed in claim 1 wherein said vertical member is of adjustable length.

6. A scaffold support as claimed in claim 1 wherein said horizontal member has a protuberance on its upper surface spaced from the point of connection of said vertical member to said horizontal member a distance sufficient to permit a plank to be laid on said horizontal member between said point and said protuberance.

7. A scaffold supported from the roof of a building having a wall and a roof supported thereon, said scaffold comprising a plurality of adjacent scaffold supports as claimed in claim 1 and a plurality of planks laid on and between the horizontal members of the said adjacent supports.

8. A scaffold as claimed in claim 7 wherein said scaffold supports include orifices in the ends of the said horizontal members, removable rod safety rail supports mounted in said orifices and a safety rail supported by said safety rail supports of adjacent scaffold supports.

9. A scaffold as claimed in claim 7 wherein planks are laid on and between the said angle members of adjacent scaffold supports.

10. A scaffold for support from the roof of a building having a wall and a roof supported thereon, a plurality of roof cleats removably secured to the edge of said roof, said cleats comprising a perforated fastening plate for securing said cleats to said roof, hooked end plates connected by a hinge to said fastening plates with the hinges located at the edge of said roof and the hooked end plates hanging down over the edge of the roof, brackets comprising vertical members having an upper ends and lower ends when mounted on the said hooked end plates, projecting angle members fastened to the upper ends of said vertical members having transverse pins at their lower end, said transverse pins being mounted in the hooked end plates, said brackets also comprising horizontal members mounted on the lower ends of said vertical members and extension legs slidably mounted parallel and adjustable relative to the said horizontal members, said extension legs being adjusted in length and position whereby when said legs bear against said wall, said vertical member is maintained in its vertical position and a plurality of planks laid on and between the horizontal members of said brackets.

* * * * *